United States Patent [19]

Saito

[11] 4,003,101

[45] Jan. 18, 1977

[54] APPARATUS FOR DRYING FILMS

[75] Inventor: Eiichi Saito, Tokyo, Japan

[73] Assignee: Fuji Photo Film Co., Ltd., Tokyo, Japan

[22] Filed: Jan. 27, 1976

[21] Appl. No.: 652,749

[30] Foreign Application Priority Data

Jan. 31, 1975 Japan ..... 50-14322

[52] U.S. Cl. ..... 15/303; 15/316 R

[51] Int. Cl.[2] ..... G03D 15/02

[58] Field of Search ..... 15/306 R, 306 A, 316 R, 15/405, 303; 34/152, 155, 158

[56] References Cited

UNITED STATES PATENTS

| | | | |
|---|---|---|---|
| 2,515,223 | 7/1950 | Hollick | 15/306 A X |
| 2,566,142 | 8/1951 | Powers | 15/306 R X |
| 3,078,496 | 2/1963 | Doran et al. | 15/306 A X |
| 3,206,870 | 9/1965 | Scharbrough | 34/155 |
| 3,390,465 | 7/1968 | Wise | 34/155 X |

*Primary Examiner*—Christopher K. Moore

[57] ABSTRACT

A film support member having a rectangular aperture is provided in contact with the surface of a film to be dried. A compressed air supply device is provided to supply air along the surface of the film from one edge of the reactangular aperture of the film support member. The edge of the aperture is tapered at an angle of 45° or less to guide the air from the air supply device along the surface of the film to have the air uniformly distributed over the film.

8 Claims, 5 Drawing Figures

APPARATUS FOR DRYING FILMS

BACKGROUND OF THE INVENTION

1. Field of the Invention

This invention relates to a drying apparatus, and more particularly to an apparatus for drying photographic films after development process by uniformly applying compressed air on the surface of the film.

2. Description of the Prior Art

It has been known in the art to dry the surface of a film after development process by applying compressed air on the surface thereof. Most of the conventional apparatus for drying the surface of the film employs a heat source such as an electric heater between a compressed air supply source and the surface of the film to be dried so that the film may be dried by an air blow of high temperature. Further, in this type of conventional apparatus, the film processed through a development station is squeezed through squeeze rollers before fed into the drying apparatus. The drying apparatus uses a drying chamber into which the compressed air of high temperature is supplied and the squeezed film is transferred. This kind of drying apparatus is widely employed in the general automatic film processer. The above described drying apparatus suffers from the defect that a squeeze rollers must be provided between the drying station and the development station. Further, the above described drying apparatus needs a large drying chamber, and accordingly, the apparatus occupies a large space. In addition, since a large amount of compressed air of high temperature is used, the drying efficiency is low. Further, the drying speed is not sufficiently high.

It has also been known in the art to dry a film mounted on an aperture card in a system wherein the film is exposed to imagewise light to form a latent image, developed, and dried while the film is mounted on the aperture card. This kind of system is disclosed, for instance, in Japanese Patent Publication No. 45-30300/1970. In this system, the film is subjected to an air blow of high temperature normally directed to the surface of the film from an air nozzle after subject subjected to a compressed air blow. This drying apparatus is advantageous over the aforesaid conventional drying apparatus in that a squeezing means is not necessitated and the size of the apparatus can be made compact since the development process and the drying process can be conducted at the same place. The drying apparatus described just hereinabove, however, is disadvantageous in that two kinds of air blow should be provided and the structure of the drying apparatus is complicated thereby. Further, in this apparatus the surface of the film is liable to be unevenly dried, which results in uneven density in the image of the film developed, since the film is subjected to an air blow normally directed to the film and radially spreading on the film. The uneven density in the image of the film markedly degrades the quality of the image.

SUMMARY OF THE INVENTION

The primary object of the present invention is to provide a drying apparatus for drying the surface of a film having a simple construction and compact size.

Another object of the present invention is to provide a drying apparatus for uniformly drying the surface of a film to obtain a film having an image of high quality.

Still another object of the present invention is to provide a drying apparatus capable of drying a film at a high speed without using a heater.

A further object of the present invention is to provide a drying apparatus capable of drying a film mounted on an aperture card.

A still further object of the present invention is to provide a drying apparatus which does not employ an air blow of high temperature nor squeeze rollers, and accordingly, is able to dry a film having a hard emulsion layer.

A still another object of the present invention is to provide a drying apparatus in which an air blow of high temperature is not employed and accordingly the material forming the air nozzle can freely be selected among various kinds of material.

The drying apparatus in accordance with the present invention is characterized in that an air blow having a uniform pressure distribution along the lateral dimension thereof is applied to the surface of the film. A film support member having a rectangular aperture is provided in contact with the surface of the film to be dried, and a compressed air supply means which supplies a compressed air on the surface of the film having a substantially uniform pressure distribution over the film is provided above the film support member to supply the compressed air from one side of the rectangular aperture. The inner edge of the four sides of the rectangular aperture is tapered by an angle of 45° or less to guide the air from the air supply means smoothly along the surface of the film. In this invention, it should be noted that the "compressed air" means not only the air having a pressure higher than one atmosphere, but also the air supplied from a blower which has a pressure less than one atmosphere.

DESCRIPTION OF THE PREFERRED EMBODIMENTS

Figure 1:
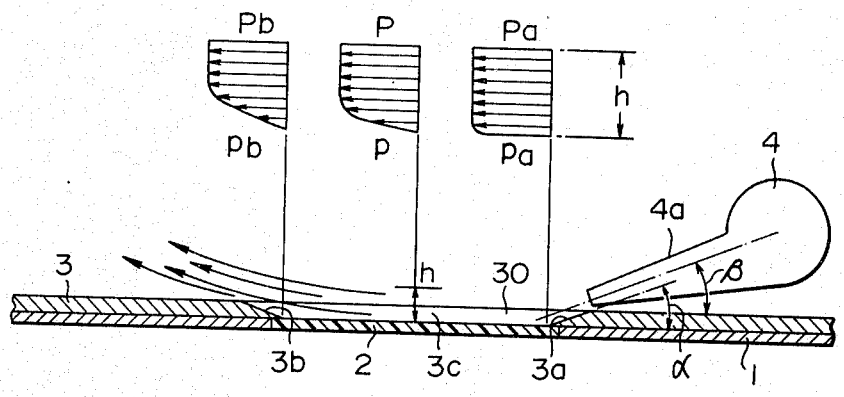
FIG. 1 is a side sectional view for explanation of the principle of the present invention.
Figure 2:
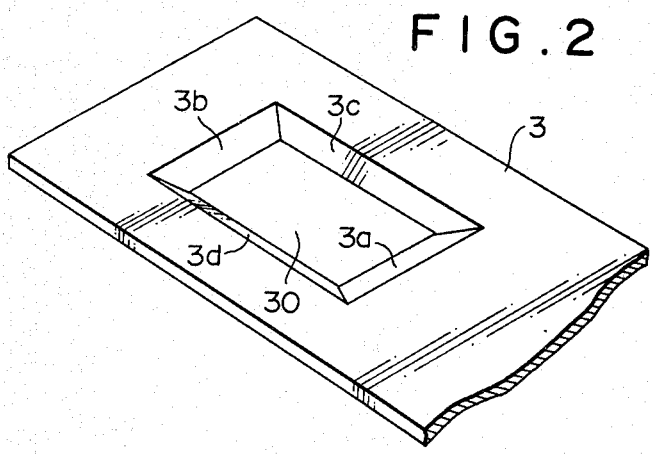
FIG. 2 is a fragmentary perspective view showing the film support member employed in the drying apparatus of this invention.

The principle of one embodiment of the present invention is illustrated in FIG. 1. On an aperture card 1 having a film 2 mounted thereto is placed a film support member 3 which has a rectangular aperture 30 defined by four side edges 3*a*, 3*b*, 3*c* and 3*d* as shown in FIG. 2. The size of the aperture 30 is substantially smaller than the size of the film 2 mounted to the aperture card 1 so that the film 2 may be firmly held by the edges of the aperture 30. At least the part of the side edges 3*a*–3*d* of the aperture 30 of the aperture card 1 is made to have a small friction coefficient. Further, the side edges 3*a*–3*d* are tapered or slanted at an angle $\alpha$ with respect to the surface of the film support member 3, i.e. the surface of the film 2 so that that outside of the film support member 3 may extend down to the surface of the film 2 supported or held thereby. Above the film support member 3 is provided an air nozzle 4 having a nozzle portion 4*a* extending skewly down to one side edge 3*a* of the aperture 30 parallel to opposite side edges 3*c* and 3*d*. The inclination of the nozzle portion 4*a* with respect to the surface of the film support member 3, i.e. the surface of the film 2 is indicated by an angle $\beta$ which is designed to be substantially equal to the angle $\alpha$ formed by said slanted side edge 3*a*. The horizontal length of the mouth of the nozzle directed to the aperture 30 should preferably be made at least equal to the width of the aperture 30. The angles $\alpha$ and $\beta$ is desired to be 45° or less, but should not preferably be larger than 30°. When the angles $\alpha$ and $\beta$ are larger than 30°, the pressure loss becomes considerably large and the time required for dyring is elongated. When the angles becomes larger than 45°, the air will swirl when it separates from the surface of the film 2 near the side edge 3*b* opposite to said side edge 3*a* along which the air comes down to the surface of the film 2. In addition, when the angles are larger than 45°, the liquid drops removed from the surface of the film 2 by the air blow will not smoothly climb up the slanted edge 3*b* of the aperture 30. In view of the above, the angles $\alpha$ and $\beta$ are selected to effect a smooth flow of the air from one end of the aperture 30 to the other and a smooth flow of the liquid drops along the surface of the film 2 and the slanted side edge 3*b* of the aperture 30 of the support member 3.

In the upper part of FIG. 1 is illustrated the vertical dynamic pressure distribution from one end to the other of the aperture 30 on the film 2. The pressure distribution at the right end of the aperture is indicated by Pa, the distribution at the middle point of the aperture is indicated by P and the distribution at the left end thereof is indicated by Pb. The distribution graphs shows the pressure distribution from the surface of the film 2 up to a level of the height of *h* above the film. Owing to the slanted side edge 3*a*, the compressed air supplied by the air nozzle 4 is effectively directed to the film 2 without being separated from the surface of the film 2 and the dynamic pressure Pa at the right end of the aperture 30 is uniformly distributed from the surface of the film 2 to the level of the height *h* as illustrated in FIG. 1. In the middle portion of the aperture 30, the dynamic pressure is reduced on the surface of the film by the friction with the film 2 and by the expansion of the air. At the other end of the aperture 30, the dynamic pressure Pb on the surface of the film 2 is further reduced. However, by the slanted edge 3*b* of the aperture 30, the air is not separated from the surface of the film and the edge 3*b* and accordingly no swirl is formed here and there is little pressure loss.

As clearly shown in FIG. 2, the other two side edges 3*c* and 3*d* are also slanted in the same way as that of the right and left side edges 3*a* and 3*b* as described above. However, it will be noted that the angle of the slanted surface of the other side edges 3*c* and 3*d* may not absolutely be equal to that of the side edges 3*a* and 3*b*. As the air blows along the surface of the film 2 in the aperture 30, the liquid on the film 2 such as a developer remaining thereon is moved therealong and blown away along the surface of the slanted side edges 3*b*, 3*c* and 3*d*. Thus, the surface of the film 2 is dried gradually from the side near the air nozzle 4.

Now a preferred embodiment of the present invention will be described in detail with reference to FIGS. 3 and 4 in which elements equivalent to those shown in FIGS. 1 and 2 are designated by the same reference numerals. An aperture card 1 having a film 2 in the aperture thereof is placed on a film suport board 3 having a rectangular aperture 30 defined by four side edges 3*a*, 3*b*, 3*c* and 3*d*. The surface of the film 2 to be dried is faced downward to the aperture 30 of the support board 3. A pressure plate 5 having a cushion pad 5*a* is placed on the aperture card 1 with the film 2 to sandwich the card 1 between the cushion pad 5*a* and the support board 3. The aperture card 1 is positioned so that the film 2 is registered with the rectangular aperture 30 of the film support board 3 and the most part of the film 2 is exposed in the aperture 30. The film support board 3 is fixed to a housing 6 which encloses the whole structure of the drying apparatus. Within the housing 6 is provided an air nozzle 4 having a nozzle portion 4*a* extending skewly to the edge 3*a* of the aperture 30 to supply an air blow on the surface of the film 2 exposed in the aperture 30. A wall 6*a* is provided with an exhaust outlet 6*b* which is opened and closed by a cover 7 hinged thereto. The exhaust outlet 6*b* is provided for discharging the air and the liquid drops from the surface of the film 2 and the cover 7 is normally closed and opened when the air blow starts to dry the film 2. The air nozzle 4 is connected with a duct 8 by a connector 9 as shown in FIG. 4.

The housing 6 is further provided with holes 10 and 11 on the bottom wall 6*c* thereof for mounting nozzles for supplying a developer liquid and rinse water. Thus, the housing 6 serves not only as a casing for a drying device but also as a casing for a developer.

Figure 3:
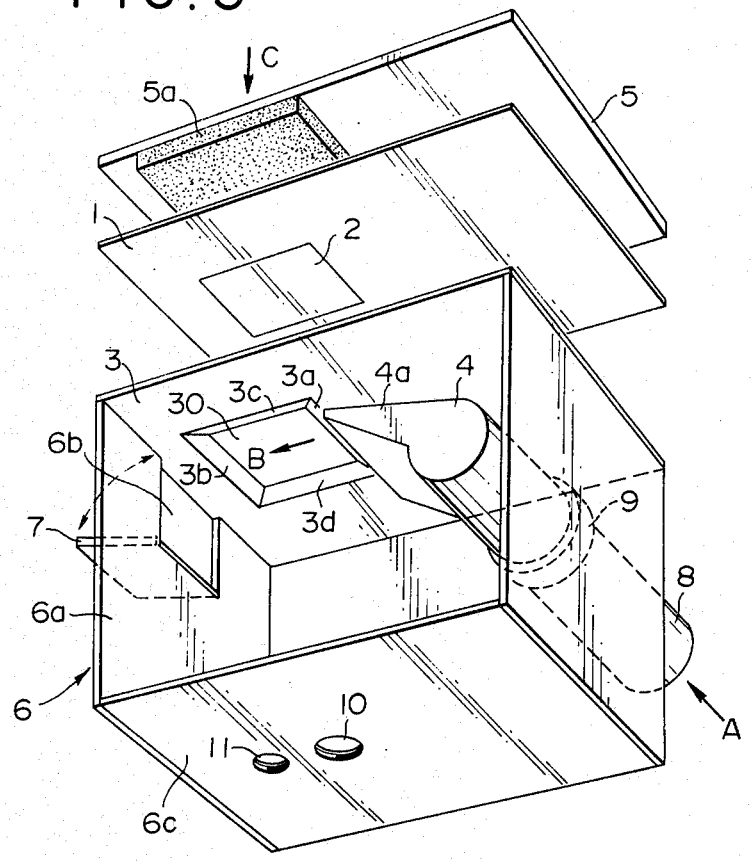
FIG. 3 is a schematic perspective view showing an embodiment of the drying apparatus of this invention.
Figure 4:
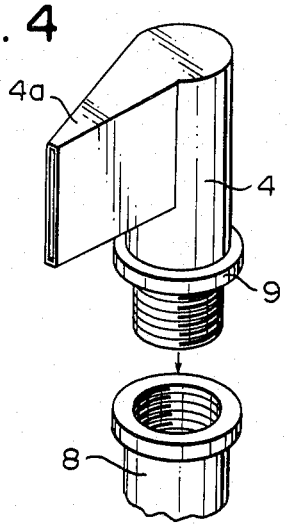
FIG. 4 is a perspective view of the air nozzle employed in the drying apparatus of this invention.

In the embodiment as shown in FIG. 3, the liquid drops are apt to drop down by the gravity since the wet surface of the film 2 faces downward. Since the aperture card 1 itself is completely shielded by the film support board 3, the card 1 is not subjected to the compressed air at all. Therefore, there is no problem of curling of the card or the like. Further, in accordance with the present embodiment as described above, the liquid content on the surface of the film 2 is effectively removed and the film 2 is effectively dried by an air blow of room temperature, i.e. 10°–20° C. The drying apparatus as described hereinabove and shown in FIG. 3 is particularly suitable for drying aperture cards carrying a microfilm and ID cards carrying a photograph.

Figure 5:
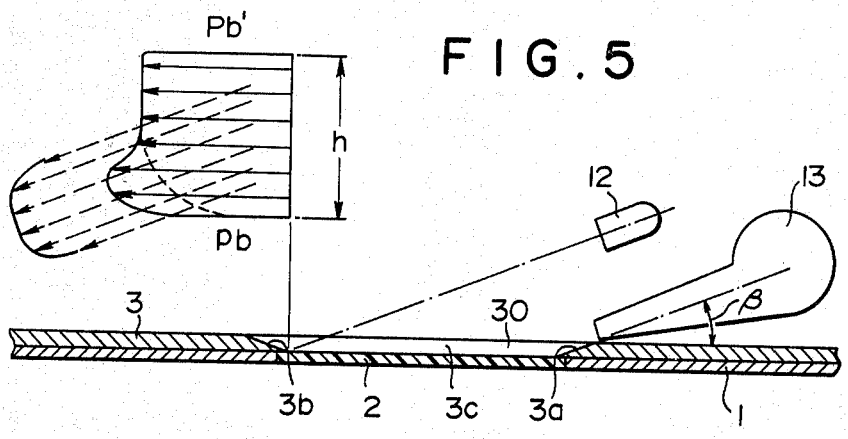
FIG. 5 is a side sectional view for explanation of the principle of an improvement embodiment of the present invention.

A second embodiment of the present invention will now be described with reference to FIG. 5 which shows the principle thereof. The drying apparatus as schematically shown in FIG. 5 is provided with an auxiliary nozzle 12 beside a main nozzle 13 to improve the pressure loss at the left end of the aperture 30 near the side edge 3*b*. The main nozzle 13 corresponds to said air nozzle 4 employed in the first embodiment, and the aperture 30 and the side edge 3*b* are equivalent to those employed in said embodiment designated by the same reference numerals. Other elements equivalent to those employed in the first embodiment are designated by the same reference numerals. The auxiliary nozzle 12 is directed to the left side edge 3*b* of the aperture 30 and is in substantially parallel to the main nozzle 13. The effective width of the slit or mouth of the auxiliary nozzle 12 is made substantially equal to that of the main nozzle 13. The dynamic pressure distribution at the left side edge 3*b* in the above case becomes as illustrated in FIG. 5 wherein the original distribution is improved as shown by Pb′ by the effect of the auxiliary nozzle 12 the effect of which is indicate by broken lines. Thus, the dynamic pressure Pb is increased near the surface of the film, and the force to remove the water content on the surface of the film is increased.

It will be understood by those skilled in the art that the air nozzle 4 or 13 in the above described embodiments may be moved along the surface of the film 2 from the right side edge 3*a* to the left side edge 3*b* to improve the drying effect of the apparatus.

EXAMPLE

In accordance with an experiment of the inventor in which a drying apparatus according to the first embodiment of the invention as shown in FIG. 3 of the following dimensions was used, a film of 35mm size MINI-COPY FILM HR (made by Fuji Photo Film Co., Ltd.), was uniformly dried (no density difference was acknowledged) by drying of five second.

| | |
|---|---|
| Static Air Pressure | 580 mmAq |
| Flow Rate | 7.5 $m^3$/min |
| Air Temperature | 15° C |
| Angle $\alpha$ | 30° |

When the same film was dried by a conventional drying apparatus employing an air blow directed normally to the surface of the film under the same conditions of the pressure, flow rate and temperature, the film was unevenly dried (density difference 0.3) by drying of ten second.

I claim:

1. A drying apparatus for drying the surface of a film comprising:

a film support member having a rectangular aperture of the size substantially smaller than the size of the film to be dried, said aperture being defined by four side edges and put into contact with the surface of the film to be dried, said side edges being slanted to extend from the outer surface of the film support member down to the surface of the film located in contact with the support member at an angle not larger than 45° with respect to the surface of the film, and a compressed air supplying means provided above the film support member for supplying an air blow in a direction parallel to two opposite side edges of the aperture to provide a uniform pressure distribution over the surface of the film along the lateral dimension thereof.

2. A drying apparatus as defined in claim 1 wherein said angle at which the side edges are slanted with respect to the surface of the film is not larger than 30°.

3. A drying apparatus as defined in claim 1 wherein said compressed air supplying means is an air nozzle having a nozzle portion directed skewly to the surface of the film at an angle substantially equal to said angle at which the side edges of the aperture is slanted with respect to the surface of the film.

4. A drying apparatus as defined in claim 3 further comprising an auxiliary air nozzle provided above the aperture of the film support member and directed to a side edge of the aperture opposite to the side edge along which the air blow from said air nozzle is applied.

5. A drying apparatus as defined in claim 4 wherein said auxiliary air nozzle and said air nozzle are inclined at substantially the same angle with respect to the surface of the film to be dried.

6. A drying apparatus as defined in claim 1 further comprising a pressure plate spaced from the back side of the film support member to sandwich the film to be dried between the film support member and the pressure plate.

7. A drying apparatus as defined in claim 6 wherein said pressure plate is provided with a cushion pad to softly sandwich the film between the film support member and the cushion pad of the pressure plate.

8. A drying apparatus as defined in claim 1 wherein said film support member is fixed to a housing, said housing comprising a side wall extending perpendicular to the film support member and facing said compressed air supplying means at a position opposite to said air supplying means with respect to said aperture of the film support member, said side wall being provided with an opening closed by a cover hinged thereto for discharging there-through the air from said air supplying means and liquid drops removed from the surface of the film.

* * * * *